US006158090A

United States Patent [19]

Patelli et al.

[11] Patent Number: 6,158,090

[45] Date of Patent: Dec. 12, 2000

[54] DEVICE AND METHOD FOR COLLECTION OF THE WEB, AND DRAWING OF THE LATTER INTO THE OUTPUT UNIT OF A CARDER

[75] Inventors: Silvano Patelli; Giovanni Battista Pasini, both of Palazzolo Sull'oglio, Italy

[73] Assignee: Marzoli S.p.A., Palazzolo Sull'oglio, Italy

[21] Appl. No.: 09/418,504

[22] Filed: Oct. 15, 1999

[30] Foreign Application Priority Data

Oct. 20, 1998 [IT] Italy ..... MI98A2250

[51] Int. Cl.[7] ..... D04H 11/00

[52] U.S. Cl. ..... 19/157; 19/236; 19/239; 19/240; 19/260

[58] Field of Search ..... 19/150, 157, 106 R, 19/236, 237, 238, 239, 256, 240, 258, 260, 261, 286, 287, 294, 296, 293

[56] References Cited

U.S. PATENT DOCUMENTS

| | | | |
|---|---|---|---|
| 3,444,594 | 5/1969 | Whitehurst | 19/239 |
| 4,213,553 | 7/1980 | Leifeld | 226/196 |
| 4,314,388 | 2/1982 | Hartmannsgruber et al. | 19/293 |
| 4,404,711 | 9/1983 | Kluttermann | 19/106 R |
| 4,473,924 | 10/1984 | Hartmannsgruber et al. | 19/239 |
| 4,703,431 | 10/1987 | Sako et al. | 19/240 |
| 4,987,734 | 1/1991 | Meyer | 19/236 |
| 5,022,123 | 6/1991 | Ueda et al. | 19/260 |
| 5,428,870 | 7/1995 | Rutz et al. | 19/240 |
| 5,839,165 | 11/1998 | Patelli et al. | 19/260 |

OTHER PUBLICATIONS

U.S. application No. 09/292,847, filed Apr. 16, 1999, allowed.

U.S. application No. 09/418,504, filed Oct. 15, 1999, pending.

U.S. application No. 09/418,429, filed Oct. 15, 1999, pending.

*Primary Examiner*—John J. Calvert
*Assistant Examiner*—Gary L. Welch
*Attorney, Agent, or Firm*—Oblon, Spivak, McClelland, Maier & Neustadt, P.C.

[57] ABSTRACT

Method and device for collection of the web, and drawing of the latter into the output unit of a carder, in which the drawing is subdivided for a first part between the compactor unit for the web and the first pair of drawing rollers for the strip, and a second drawing part between the rollers of the drawing unit for the strip.

18 Claims, 3 Drawing Sheets

DEVICE AND METHOD FOR COLLECTION OF THE WEB, AND DRAWING OF THE LATTER INTO THE OUTPUT UNIT OF A CARDER

BACKGROUND OF THE INVENTION

1. Field of the Invention

The present invention relates to machines for carding of textile fibres, in which the flock fibres are worked in order to produce a web of fibres. In this operation, the short fibres and tangles are removed from the fibres, which are stretched and placed in parallel in a web of fibres, which is disposed on the covering of the drum of the carder, from which the web of fibres is collected by a rotary detachment cylinder with a suitable covering, which is commonly known as a doffer, and is then transferred by another doffer to a compactor unit and to a drawing unit, in order to produce a strip of fibres.

More particularly, the present invention relates to the method and the device in which the web which is detached from the carder is transformed into a strip, and is subjected to controlled and progressive drawing, in order to obtain a constant, predetermined yarn count.

2. Discussion of the Background

In order to assist understanding of the technical aspects involved in the carding, reference is made to a diagram of a collection and drawing unit according to the known art, which is described in European patent application no. 775, 768 in the name of the same applicant, illustrated in FIGS. 1 and 2, which show respectively a schematic lateral view and a plan view of the collection and drawing unit.

The detachment cylinder, or doffer, of the carder, is indicated as 1, and on the latter the web 2 of fibres is carried to the unloading cylinder 3, and is conveyed to the compactor unit 4, which consists of a pair of smooth rotary cylinders 5,6, with a substantially horizontal axis, which compact the web 2, which still has a transverse dimension which corresponds to that of the carder, and transfer the web to the subsequent belt conveyor. The compactor unit 4 works at a speed which is the same as, or slightly greater than that of the web 2 which is obtained from the unloader 3.

The belt conveyor 10 is in a position which is integral with the collection unit of the web 2 described hitherto, and consists of a pair of belts 11 in a loop, which are opposite, and are guided by means of rollers 12 which have a substantially vertical axis, rotate on pins 13, and are provided with rotary drive 14, by means of their own motor, or by motion derived from other units, in a known manner. The said belts 11 extend along the entire front of the collection unit, as far as lateral return rollers which are not shown in the figure for the sake of simplicity, and leave a central gap 15. The belts are actuated such as to be moved, in the area which is provided for the web of fibres obtained from the compactor unit 4, from the sides towards the centre, in order to concentrate and convey the web 2 of fibres into a strip 16, which has a width which corresponds to the gap 15 between the two belts 11. The stretched web 2, which has been condensed into the form of a strip 16, is then yielded to the drawing unit 20, and the linear speed of transfer of the fibrous body is substantially maintained from the compactor unit 4 to the drawing unit 20.

The equipment of the drawing unit 20 is mounted on a mobile carriage, which can move longitudinally, towards and away from the preceding collection unit. This movement is obtained, for example, by placing the equipment of the drawing unit on a transverse frame 21, which slides forwards and rearwards according to the arrow 22 on guides, and is piloted by a double-effect hydraulic cylinder, which is not shown in the figure for the sake of simplicity.

The drawing unit comprises a body in the shape of a funnel 30, which receives the fibres conveyed by the belts 11 in order to form the strip 16, and admits and guides them to the two pairs of cylinders downstream, which carry out the drawing of the strip 16. Of these pairs of cylinders, a first pair of cylinders or rollers 31 and 32 with a horizontal axis comprises the upper roller 31, which is smooth and idle, and is pressed against the roller 32 beneath by means of an adjustable thruster 33 on its shaft 34. The roller 32 is embossed in a transverse direction, and is rotated with a specific drive ratio in a known manner, for example with a pulley and belt drive system, by means of the motor 35. According to the known art, and in general, the first pair of rollers 31,32 works at a linear speed which is slightly greater than that of the strip which is released by the belt conveyor 10, via the funnel 30.

The second pair of cylinders or drawing rollers comprises the roller 38, which is also smooth and idle, and is pressed against the roller 39 beneath, similarly to the first pair of cylinders. The roller 39 is also worked on its surface, and is actuated such that it is driven at a linear speed which is greater than that of the roller 32, according to a ratio which is adjustable, and greater than 1, which gives rise to the drawing, i.e. to the elongation of the strip, which is conveyed between the two pairs of rollers. In other words, the second pair of cylinders 38,39 is actuated such as to be driven at a specific linear speed, which is greater than that of the first pair of cylinders 31,32. Owing to the effect of the linear speed difference between the rollers upstream which release the body of fibres, and the rollers downstream which draw this body towards them, the fibres which are drawn downstream slide relative to the fibres which are retained upstream, and give rise to elongation and drafting of the said body of fibres. The drawing values express ratios between the linear speeds of the fibrous body input, and the fibrous body output.

For this purpose, the two pairs of drawing rollers 31,32 and 38,39 are actuated in a known manner, for example by means of the same motor 35, which is provided with a drive with belts and pulleys of a different diameter, and maintain a pre-determined, constant ratio between the linear speeds at which the strip which is gripped between the two pairs of rollers is yielded by the first pair 31,32, and drawn by the second pair 38,39. In general, the drawing values, which are established between the two pairs of rollers are between 1.0 and 2.0, whereas the values which are currently used are within the narrower interval between 1.1 and 1.5.

The strip which is thus produced and drawn is then sent to be collected in a container, for further processing. The distance between the drawing unit and the collection unit is regulated in accordance with the speed at which the carder is actuated, and with the linear speed of collection of the web, as well as in accordance with the characteristics of the fibres worked.

The problems which arise during the step according to the known art, of collection of the web and drawing of the strip of fibres, are derived substantially from the present need to operate at high levels of productivity in terms of linear production of web and strip, which, in operation, must be collected and drawn at a rate of 250–400 m per minute, and this value is destined to increase further, according to the expectations of the textile industry. High speeds of work create problems, in particular in the steps of re-starting, or in general in a transitional stage, in which the sections of web and strip between one point of collection and control and the other can be loose or slack, and can also be disposed in a highly accentuated catenary position. This occurrence is problematic because the consistency of the web and the strip is substantially reduced, since they consist of fibres in parallel. In these loose sections the web and the strip can lose continuity, owing to their own weight, and because of lack of continuity of the drawing to which they are subjected, and this can cause stoppage of production. The technical problem which is derived from these requirements of high carding productivity consists of control and recovery in good time of the loose sections of the web and strip, such that the latter are kept satisfactorily taut even in the transitional and starting steps.

SUMMARY OF THE INVENTION

The object of the present invention is to provide a method and a device for collection of the web and drawing of the strip produced by a carder, with control of satisfactory tautness and tensioning of these bodies of fibres.

The present invention consists of a device and a method for collection of the web and drawing of the strip produced by a carder. The device consists substantially of a drive system, the salient characteristics which are described, and the preferred embodiments of which are described in the claims which are dependent on the latter; the salient characteristics of the method are described and the preferred embodiments are described in the claims which are dependent on the latter.

BRIEF DESCRIPTION OF THE DRAWINGS

A more complete appreciation of the invention and many of the attendant advantages thereof will be readily obtained as the same becomes better understood by reference to the following detailed descriptions when considered in connection with the accompanying drawings, wherein.

DESCRIPTION OF THE PREFERRED EMBODIMENTS

Figure 1:
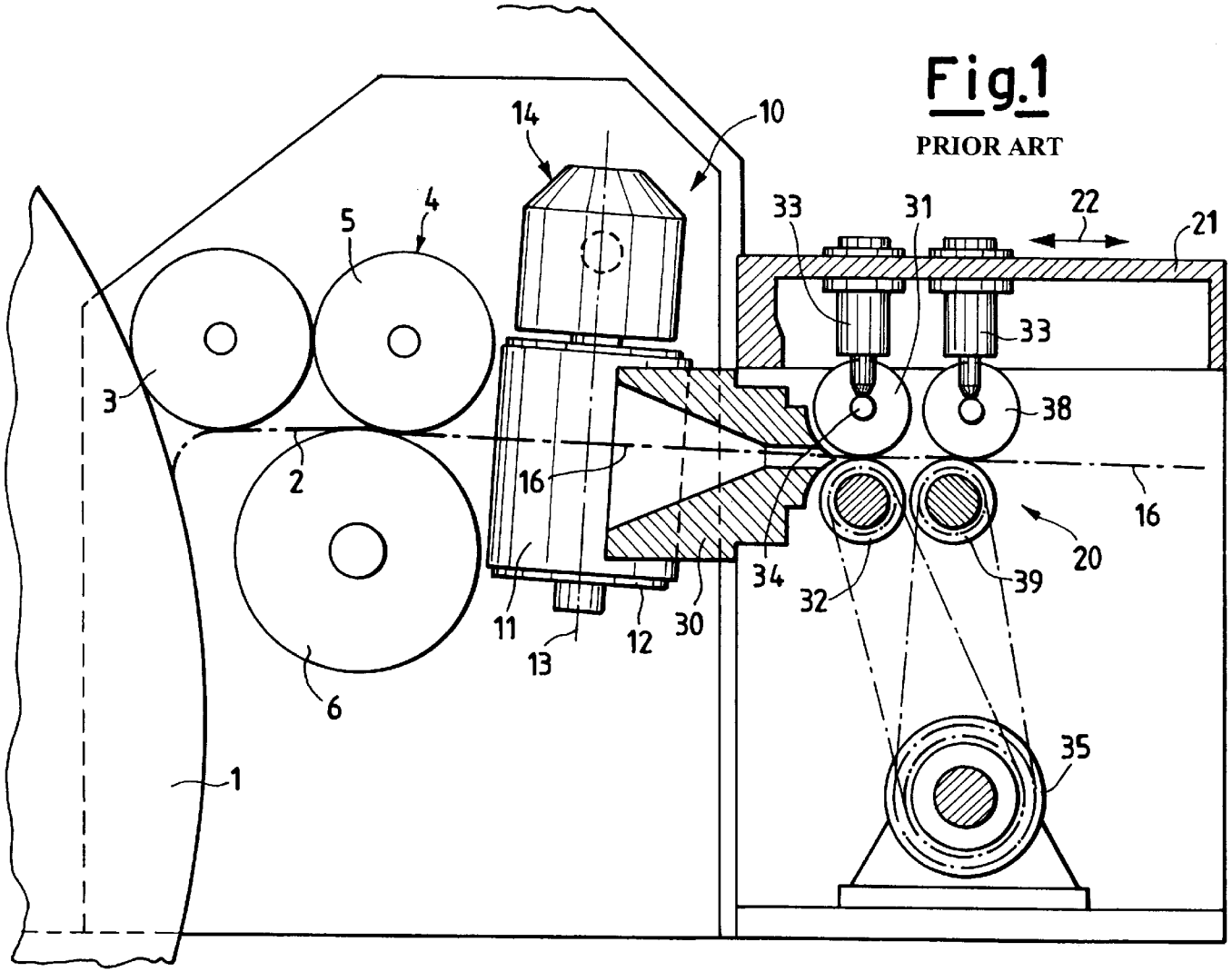
Fig.1 PRIOR ART
FIGS. 1 and 2 illustrate the technical problem in general.
Figure 2:
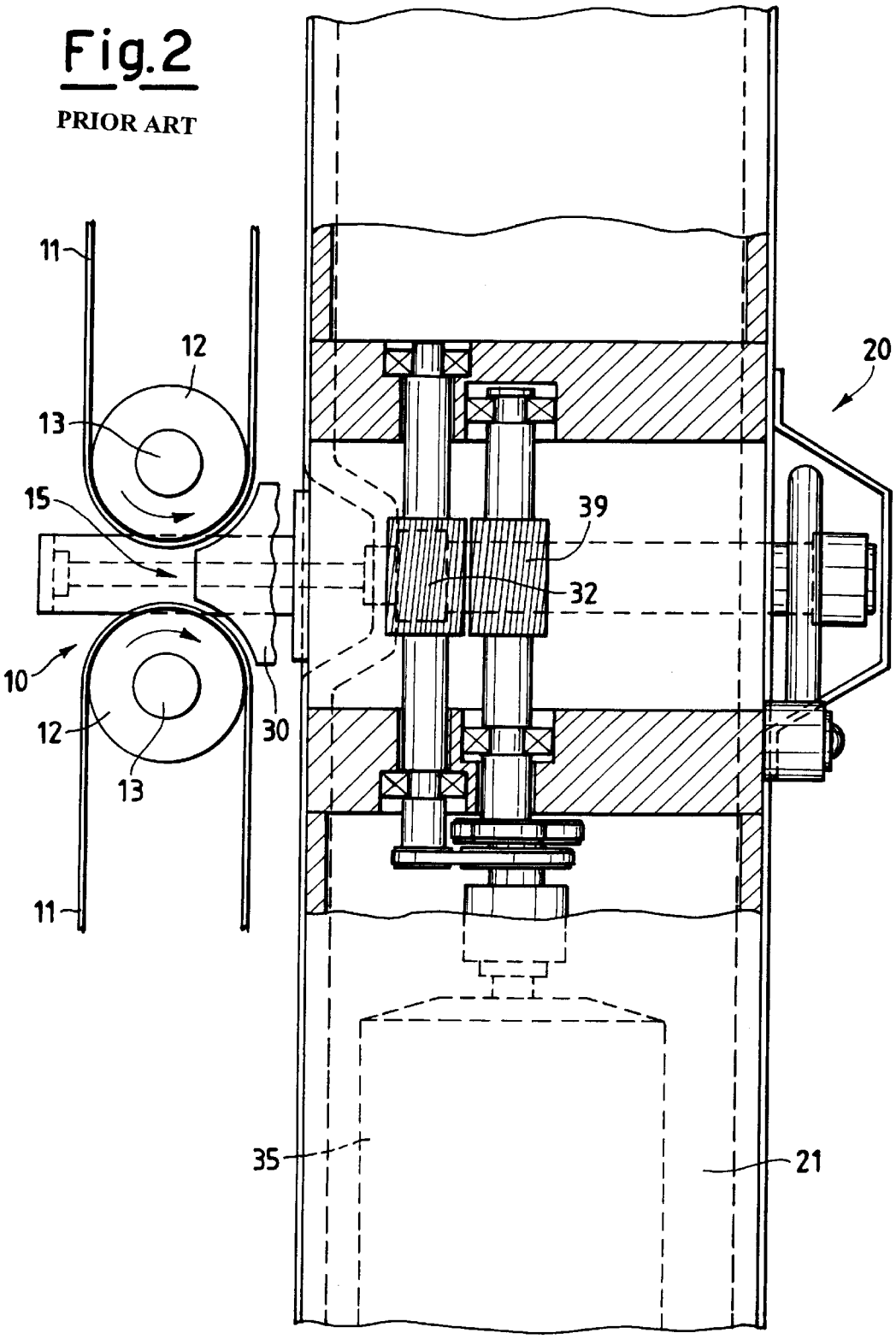
Fig.2 PRIOR ART
Figure 3:
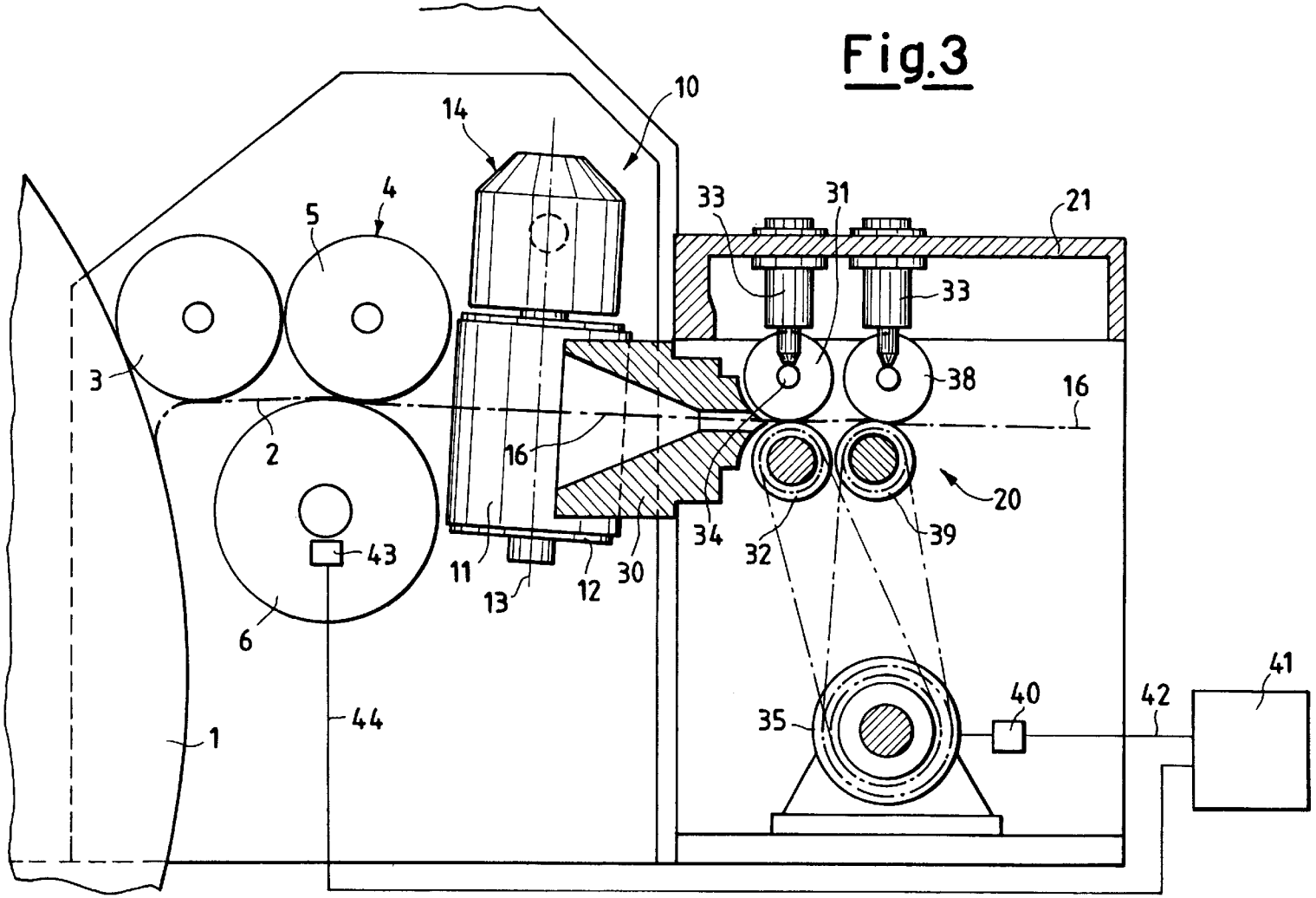
FIG. 3 shows a diagram of the drive system of the unit according to the invention, for collection of the web, and drawing of the latter into a strip.

Referring now to the drawings, wherein like reference numerals designate identical or corresponding parts throughout the several views, and more particularly to FIG. 3 thereof, there is illustrated an exemplary embodiment of the present invention.

FIG. 3 shows an embodiment of the invention in which the drawing operation is divided up into two sections. The compactor unit 4 is still actuated at the linear speed at which the web 2 is yielded by the doffer 1, but the first pair of cylinders or drawing rollers 31,32, which engages the strip 16 at the output of the funnel-shaped body 30, is actuated at a controlled linear speed, which is substantially higher than that of yielding of the web by the compactor unit 4, with a drawing value between the two of between 1.4 and 2.2 at operating speed, and preferably between 1.6 and 2.0.

For this purpose, the two pairs of drawing rollers 31,32 and 38,39 are actuated, by way of example, by the motor 35 which is provided with appropriate transmission to the two pairs of rollers, and maintains a constant ratio between the linear speeds at which the strip which is gripped between the two pairs of rollers is yielded by the first pair 31,32, and drawn by the second pair 38,39. According to the invention, this motor 35 is an A.C. electric motor, which is actuated at a variable speed, and supplied with a variable frequency by means of an inverter 40, which is piloted by the control unit 41 of the carder, via the connections 42. In turn, the compactor unit 4 is actuated by means of an A.C. electric motor, which is supplied with frequency, or is rotated by the doffer 1 or by other units of the carder, such as to impart a pre-determined, constant linear speed to the web 2 which is yielded in the downstream direction. This speed is measured and transmitted to the control unit 41 of the machine, for example by means of the signal which is conveyed to the latter by a sensor 43 which is disposed on this unit 4, and is connected to the line 44. On the basis of this signal and the geometric characteristics of the rollers concerned, the control unit 41 in turn pilots the inverter 40, such as to actuate the frequency of the motor 35, in order for the first pair of rollers 31,32 of the drawing unit 20 to draw the strip at the linear speed which corresponds to the required drawing, in the section between the compactor unit 4 and the first pair of rollers 31,32. In other words, the drawing unit 20 is provided with drive, by means of which its first pair of drawing rollers 31,32 draws the strip 16 at a higher linear speed, and with a controlled ratio relative to the speed of the compactor unit 4, in order to carry out drawing of the strip 16 between this compactor unit 4 and the pair of rollers 31,32.

The remaining part of the drawing is carried out between the first 31,32 and the second 38,39 pair of rollers, in a known manner. Similarly, if the compactor unit 4 is also actuated by means of an A.C. electric motor with an inverter, in order to pilot the frequency of the unit, this inverter is then also connected to, and controlled by the control unit 41, for the necessary co-ordination of the linear speeds in the compactor unit and in the drawing unit.

Also, in the embodiment described hitherto of the invention, the arrangement of the drawing unit is advantageous, and substantially consists of the two pairs of drawing cylinders and of the funnel-shaped body 30, on a mobile frame 21, which can move in a longitudinal direction. This arrangement makes it possible to regulate the distance which exists between the belt conveyor 10 and the drawing unit 20, which corresponds to a section of strip in which the first part of the drawing takes place.

The method for collection of the web 2 and drawing of the strip 16 according to the present invention thus consists substantially of subdividing the drawing operation into two parts, i.e. a first drawing part between the compactor unit 4 for the web, and the first pair of drawing rollers 31,32, with a drawing value of between 1.4 and 2.2 at operating speeds, and preferably of between 1.6 and 2.0; and a second drawing part between the two pairs of rollers 31,32 and 38,39, which is carried out in a conventional manner, but is preferably limited to drawing values of between 1.1 and 1.5. The overall drawing which is imparted to the web 2 which is gathered into the strip 16 at the output of the carder is between 1.6 and 3.3, and is preferably between 1.8 and 3.0.

As an alternative to the system described hitherto, the actuation of the drawing unit can be provided separately by means of two A.C. electric motors, one for each pair of drawing rollers. In this case, each motor is supplied with frequency by its own inverter, both of which are piloted by the control unit, in order to provide the required linear speed ratio between the two, and consequent drawing of the strip between them. The linear speed of the first pair of rollers 31,32 is always piloted relative to that of the compactor unit 4, such as to subdivide the drawing in the required manner.

An important factor consists of the reliability of the operations in the transitional steps or during starting of the carder, in which the web 2 or the strip 16 may not be subjected to excessive stresses, and may not be discontinuous. In such cases the carder must be stopped, and the operator must recommence from the beginning of the starting procedure, with a consequent loss of time and material.

In a preferred embodiment of the method according to the present invention, in the transitional steps, and in particular in the step of starting the machine, operation takes place with low drawing values in the first section between the compactor unit 4 for the web and the first pair of drawing rollers 31,32, with initial drawing values of between 1.0 and 1.3, and preferably of approximately 1.1. In this step, the strip is inserted in the drawing unit, and the distance between the collection unit and the drawing unit is modulated. During starting or re-starting, the operator must take the web from between the belts and insert it into the drawing unit, and in this step it is probable that the web will slacken between the various units. When operation has started, the drawing value is then progressively increased to the operating values, which are between 1.4 and 2.2, and preferably between 1.6 and 2.0. This increment in the drawing values can be applied in steps or continuously. This progressive increase in speed permits more reliable starting, and control and recovery of the loose sections. During the starting or transitional steps, the linear speeds of the compactor unit 4 and the linear speed ratio between the two pairs of rollers 31,32 and 38,39 of the drawing unit can on the other hand be maintained at the operating speed.

Similarly to in the starting step, the device according to the invention makes it possible to actuate modulation of the speeds of the compactor unit 4 and of the drawing unit 20, as well as of their ratios in the steps of slowing down or stoppage of the carder, such as to ensure that the content of the fibres in the machine is always discharged in a strip according to the specifications, and without any clogging, even when the supply upstream is modified.

The method and the device according to the present invention constitute significant progress in relation to the known art, and at least the following aspects merit explicit consideration.

For the same characteristics of the fibres being worked, the subdivision of the drawing into two sections permits a better overall drawing value, and/or improved regularity of the transverse dimension of the strip produced, which is commonly indicated as the CVt.

The better overall drawing value permits increased production of the carder, since its coverings can hold a greater thickness of layer of fibres for the same CVt to be produced. The web is more consistent in its initial section, and is thus less subject to tearing and breakages during collection.

The method for starting with modulation of the value of the drawing in the first section between the compactor unit 4 and the first pair of rollers 31,32 makes it possible to start the machine with a web which is more consistent, and to recover in good time any slack, as well as to prevent breakages of the web or strip, and to avoid repetition of the starting operations. This starting method leads to consistent saving of time and material, and provides an improved factor of service of the machine.

Obviously, numerous modifications and variations of the present invention are possible in light of the above teachings. It is therefore to be understood that within the scope of the appended claims, the invention may be practiced otherwise than as specifically described herein.

What is claimed is:

1. A device for collection and drawing of a web of fibers, comprising:

a doffer;

an unloading cylinder;

a compactor unit;

a belt conveyor;

a controller; and a drawing unit, including, a body, and first and second pairs of driven cylinders provided downstream of the body, wherein the device concentrates the web of fibers into a strip with a width which corresponds to a gap in the body, the strip is provided to the body of drawing unit, the body guides the strip to the first and second pairs of driven cylinders which carry out the drawing, the first and second pair of driven cylinders are coupled to the controller, the first and second pair of driven cylinders are actuated via the controller, such that the linear speed of the second pair of driven cylinders is higher than that of the first pair of driven cylinders, the first pair of driven cylinders are actuated via the controller, such that the first pair of driven cylinders draws the strip at a linear speed which is greater than that of the compactor unit, and the first pair of driven cylinders are actuated via the controller, such that a ratio between the linear speeds of the first pair of driven cylinders and the compactor unit is controlled during drawing of the strip between the compactor unit and the first pair of driven rollers.

2. The device of claim 1, wherein the first and second pair of driven cylinders of the drawing unit are actuated by means of an AC electric motor, the electric motor is coupled to an inverter controlled by the controller, whereby the first pair of driven rollers impart to the strip a linear speed which corresponds to a required drawing speed in a section between the compactor unit and the first pair of driven rollers.

3. The device of claim 2, wherein on the compactor unit there is disposed a speed measurement sensor, which is coupled to the controller, such that an actuation of frequency of the AC electric motor is controlled.

4. The device of claim 1, wherein the drawing unit is disposed on a mobile frame, which can move the drawing unit in a longitudinal direction.

5. The device of claim 1, wherein, during operation of the device, the controller actuates the first and second pair of driven cylinders, such the drawing of the strip is carried out with a drawing value in the range of 1.4 and 2.2.

6. The device of claim 5, wherein, during operation of the device, the controller actuates the first and second pair of driven cylinders, such that the drawing of the strip is carried out with a drawing value in the range of 1.6 and 2.0.

7. The device of claim 5, wherein, when the device is first started, the controller actuates the first and second pair of driven cylinders, such the drawing of the strip is carried out with a drawing value in a range of 1.0 and 1.3, and then the controller actuates the first and second pair of driven cylinders, such the drawing of the strip is carried out with the drawing value in a range of operation of the device.

8. The device of claim 7, wherein, when the device is first started, the controller actuates the first and second pair of driven cylinders, such the drawing of the strip is carried out with a drawing value of 1.1, and then the controller actuates the first and second pair of driven cylinders, such the drawing of the strip is carried out with the drawing value in a range of operation of the device.

9. The device of claim 5, wherein the controller actuates the first and second pair of driven cylinders, such the drawing of the strip is carried out with incremental drawing values.

10. A method for collection and drawing of a web of fibers, in a device, including a doffer, an unloading cylinder, a compactor unit, a belt conveyor, a controller; and a drawing unit, including, a body, and first and second pairs of driven cylinders provided downstream of the body, the method comprising:

concentrating the web of fibers into a strip with a width which corresponds to a gap in the body, the strip being provided to the body of drawing unit;

guiding the strip via the body to the first and second pairs of driven cylinders which carry out the drawing;

coupling the first and second pair of driven cylinders to the controller;

actuating the first and second pair of driven cylinders via the controller, such that the linear speed of the second pair of driven cylinders is higher than that of the first pair of driven cylinders;

actuating the first pair of driven cylinders via the controller, such that the first pair of driven cylinders draws the strip at a linear speed which is greater than that of the compactor unit; and actuating the first pair of driven cylinders via the controller, such that a ratio between the linear speeds of the first pair of driven cylinders and the compactor unit is controlled during drawing of the strip between the compactor unit and the first pair of driven rollers.

11. The method of claim 10, comprising:

actuating the first and second pair of driven cylinders of the drawing unit by means of an AC electric motor, the electric motor being coupled to an inverter controlled by the controller, whereby the first pair of driven rollers impart to the strip a linear speed which corresponds to a required drawing speed in a section between the compactor unit and the first pair of driven rollers.

12. The method of claim 11, further comprising:

controlling an actuation of frequency of the AC electric motor via a speed measurement sensor disposed on the compactor unit, and which is coupled to the controller.

13. The method of claim 10, further comprising:

moving the drawing unit in a longitudinal direction via a mobile frame disposed on the drawing unit.

14. The method of claim 10, further comprising:

actuating the first and second pair of driven cylinders, such the drawing of the strip is carried out with a drawing value in the range of 1.4 and 2.2, during operation, via the controller.

15. The method of claim 14, comprising:

actuating the first and second pair of driven cylinders, such that the drawing of the strip is carried out with a drawing value in the range of 1.6 and 2.0, during operation, via the controller.

16. The method of claim 14, further comprising:

actuating the first and second pair of driven cylinders, such the drawing of the strip is carried out with a drawing value in a range of 1.0 and 1.3, when operation is first started, via the controller actuates; and actuating the first and second pair of driven cylinders, such the drawing of the strip is carried out with the drawing value in a range of operation, via the controller.

17. The method of claim 16, further comprising:

actuating the first and second pair of driven cylinders, such the drawing of the strip is carried out with a drawing value of 1.1, when operation is first started, via the controller; and actuating the first and second pair of driven cylinders, such the drawing of the strip is carried out with the drawing value in a range of operation, via the controller.

18. The method of claims 14, further comprising:

actuating the first and second pair of driven cylinders, such the drawing of the strip is carried out with incremental drawing values, via the controller.

* * * * *